US008596402B2

(12) United States Patent
Abidi

(10) Patent No.: US 8,596,402 B2
(45) Date of Patent: Dec. 3, 2013

(54) SAFETY DEVICE FOR CONTROLLING THE OPENING OF AN AUTOMOBILE DOOR

(75) Inventor: Ahmed El Abidi, Cretell Cedex (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

(21) Appl. No.: 13/133,841

(22) PCT Filed: Dec. 4, 2009

(86) PCT No.: PCT/EP2009/066454

§ 371 (c)(1),
(2), (4) Date: Aug. 23, 2011

(87) PCT Pub. No.: WO2010/069787

PCT Pub. Date: Jun. 24, 2010

(65) Prior Publication Data

US 2011/0290577 A1 Dec. 1, 2011

(30) Foreign Application Priority Data

Dec. 19, 2008 (FR) ..... 08 07249

(51) Int. Cl.
*E05B 3/00* (2006.01)

(52) U.S. Cl.
USPC ..... 180/286; 180/274; 292/336.3

(58) Field of Classification Search
USPC ..... 180/274, 286, 282; 292/336.3, 93; 70/237; 49/262
See application file for complete search history.

(56) References Cited

U.S. PATENT DOCUMENTS

| | | | | |
|---|---|---|---|---|
| 5,318,145 | A * | 6/1994 | Vollmer | 180/274 |
| 5,769,471 | A * | 6/1998 | Suzuki et al. | 292/336.3 |
| 6,241,294 | B1 | 6/2001 | Young et al. | |
| 6,832,499 | B2 * | 12/2004 | Stillwagon | 70/208 |
| 8,360,486 | B2 * | 1/2013 | Gschweng et al. | 292/336.3 |
| 2007/0284894 | A1 * | 12/2007 | Rodawold et al. | 292/336.3 |
| 2007/0294861 | A1 | 12/2007 | Cummins et al. | |
| 2008/0001415 | A1 | 1/2008 | Cummins et al. | |
| 2008/0054652 | A1 * | 3/2008 | Cummins et al. | 292/336.3 |
| 2009/0230700 | A1 | 9/2009 | Arabia et al. | |
| 2010/0052335 | A1 * | 3/2010 | Rodawold et al. | 292/180 |
| 2010/0171325 | A1 * | 7/2010 | Takagai et al. | 292/336.3 |
| 2011/0248518 | A1 * | 10/2011 | Tien | 292/336.3 |

FOREIGN PATENT DOCUMENTS

| | | | |
|---|---|---|---|
| DE | 196 42 698 | A1 | 11/2000 |
| FR | 2 795 445 | A1 | 12/2000 |
| WO | 01/11172 | A1 | 2/2001 |
| WO | 2008/068259 | A1 | 6/2008 |
| WO | 2009/036419 | A2 | 3/2009 |
| WO | 2009/046892 | A1 | 4/2009 |

OTHER PUBLICATIONS

International Search Report w/translation from PCT/EP2009/066454 dated Mar. 8, 2010 (6 pages).

* cited by examiner

*Primary Examiner* — Karen Beck
(74) *Attorney, Agent, or Firm* — Osha Liang LLP

(57) ABSTRACT

The invention relates to a safety device for controlling the opening of an automobile door (100). According to the invention, the device (130) includes means (131, 132, 133) for blocking said control in the event of a side impact. The invention can be used for automobile safety with respect to side impacts.

11 Claims, 1 Drawing Sheet

SAFETY DEVICE FOR CONTROLLING THE OPENING OF AN AUTOMOBILE DOOR

The present invention relates to a safety device for a motor vehicle door opening control.

The invention is applied, in a particularly advantageous manner in the field of securing motor vehicles against side impacts.

In a general manner, doors constitute important safety elements of motor vehicles, since not only do they contribute towards the rigidity of the passenger compartment as a whole, but they also protect the occupants of the vehicle from the risks of being thrown out in the event of an accident.

It is for this reason that standards relating to side impacts, in which the doors are more highly involved, are increasingly strict and require that the doors of vehicle must remain closed during and after a side impact. However, following the impact, emergency personnel, such as firefighters, who become involved after an accident involving a side impact, must be able to open the doors without difficulty in order to free the people inside the vehicle.

In order to comprehend the difficulties associated with implementing these standards, it is advisable to bear in mind a number of technical elements relating to the closing and opening of motor vehicle doors.

A door is closed by the bolt of the lock engaging in a strike located on a pillar of the door. When the door is opened from outside the vehicle, the bolt is disengaged from the strike by the actuation of a system known under the generic name of "external opening control". This system comprises a handle which, when it is pulled by the user, drives a control lever which is intended to pull on one end of a cable which is connected at its other end to the bolt of the lock. Thus, the action exerted on the handle translates, through the operating mechanism of the external opening control, into the disengagement of the bolt from the strike and thus into the opening of the door. When the user releases the handle, the latter is returned to its starting position by a return spring.

There also exists inside vehicles an opening system called "internal opening control", the operating mechanism of which is of the same type as that of the external opening control but independent of the latter.

In the absence of any safety device, it is understood that, in the event of a side impact, the inertial force linked to the mass of the handle can reach, or even surpass, the traction force that is usually necessary to open the door. Specifically, it must be recalled that a side impact is capable of producing on the handle instantaneous accelerations of several hundred times the acceleration due to gravity. The intensity of the inertial forces generated can thus be considerable, even with lighter handles. Moreover, the stiffness of the return spring of the handle is of course highly insufficient to oppose the opening force exerted by the inertial force applied to the handle.

In order to meet the safety standards imposed in the event of a side impact, various solutions have been proposed to the problem posed by the accidental opening of the doors under the effect of inertia applied to the handle.

A first solution consists of a device having a counterweight and a return spring. The counterweight is mounted on a shaft to which the handle is also connected, so as to produce on the shaft, during a side impact, an inertial torque opposite to that of the inertial force applied to the handle. This safety device works by inertial compensation without, however, opposing the normal opening movement of the door, since these movements are slow and have low acceleration. When a user pulls on the handle in order to open the door, he simultaneously drives the counterweight of the safety device, this counterweight then being returned to its initial position by the return spring when the user releases the handle.

Generally, the counterweight is made of a dense metal such as zamak (registered trademark).

The advantage of this first solution is that it is relatively inexpensive, but it does have a number of other drawbacks. In particular, the presence of the counterweight increases the space requirement of the external opening control system in the thickness of the door and increases the weight of the vehicle with non-functional masses. In addition, this known safety device does not work at very high accelerations on account of the inertia of the counterweight. Safety is thus not guaranteed 100%. Finally, it is a passive device which only triggers in the event of a side impact.

A second solution proposed in the prior art is also an inertial solution, but works this time by blocking the operating mechanism of the external opening control. This second known safety device consists of an inertial mass arranged so as to drive, during a side impact, a member that is able to block, for example, the cable control lever, thereby preventing the bolt of the lock from disengaging from the strike. As for the preceding known device, a return spring is present to return the inertial mass to its starting position.

The advantage of this second device is that it is more compact, takes up less space and is lighter than the first device. Its drawbacks lie in the risk of the inertial mass bouncing out of its blocking position under the effect of high accelerations. In addition, in a similar way to the first device described above, it is also a passive system that does not guarantee safety 100%.

Thus, it is an aim of the invention to provide a safety device for a motor vehicle door opening control, which safety device would make it possible to guarantee 100% safety with regard to the opening of the doors in the event of a side impact.

According to the invention, this aim is achieved in that said device comprises means for blocking said control in the event of a side impact.

The means for blocking the opening control can be activated both when the vehicle is moving and when it is at a standstill, thereby ensuring that they are still active during a side impact under whatever circumstances, when the vehicle is moving or at a standstill, and whatever the intensity of the impact. Specifically, the safety device according to the invention is not an inertial device employed solely at the moment of a side impact, but a device that is active at all times, thus before any side impact can occur. It is therefore independent of the acceleration and guarantees safety 100%.

According to one embodiment of the invention, said blocking means comprise a blocking member that engages with the opening control, and an actuator that is able, on the one hand, to activate said blocking member into the blocked position and, on the other hand, to deactivate said blocking member from said blocked position.

In this embodiment, it is the blocking member that holds the door. The function of the actuator is to move the blocking member into the locking position of the door and also to disengage it from this position in order to allow the door to be opened under normal use conditions of the vehicle, in the absence of a side impact.

Two exemplary embodiments of the blocking means are envisioned by the invention.

According to a first exemplary embodiment, said blocking means are able to block a handle of said opening control.

According to a second exemplary embodiment, said blocking means are able to block a cable operating lever of said opening control.

In a particular embodiment, said blocking member comprises a pin that can be introduced into a slot formed in the opening control.

The invention furthermore provides that said blocking means are able to yield under an action exerted on the opening control following a side impact with said door. By way of example, said blocking member is breakable and can be broken under said action exerted on the opening control following a side impact with said door.

This property of the blocking member has the advantage of making it possible to open a damaged door without great difficulty following a side impact. Specifically, after such an impact, the blocking member remains in the position where it keeps the opening control locked and thus prevents the opening of the door by the emergency services. Nevertheless, on account of the breakable nature for example of the blocking member, the door can be opened easily by using means which the emergency services generally have to hand to break said member. Of course, the strength of the blocking member has to be calibrated so as to be high enough that it does not break during the side impact, while remaining lower than the forces produced by the extrication equipment for example.

According to an advantageous embodiment, said blocking means are activated when said door is closed.

In particular, said blocking means are activated by a sensor for detecting the closure of the vehicle door. This arrangement makes it possible to activate the blocking means when the door is closed both from the inside and from the outside of the vehicle.

Alternatively, the invention provides that said blocking means are activated by a starting operation of the vehicle. In this variant, the blocking means are activated when the driver of the vehicle is present in the passenger compartment.

The invention also provides that said blocking means are deactivated when said door is opened.

In this case, it is possible to envision that said blocking means are deactivated by means of a switch coupled to a door internal opening control. This switch cuts for example the electrical power supply of a mechanical or electromechanical actuator in order to return a blocking member, such as a pin, into the unlocked position of an element of the external opening control, handle or cable-pull control lever.

However, it is also possible as an alternative to envision that said blocking means are deactivated by mechanical coupling between a door internal opening control and said blocking means. It is thus necessary to add to the operating mechanism of the internal opening control an element for coupling to the operating mechanism of the external opening control.

The following description with regard to the appended drawings, which are given by way of nonlimiting examples, will make it easy to understand the substance of the invention and how it can be produced.

Figure 1:
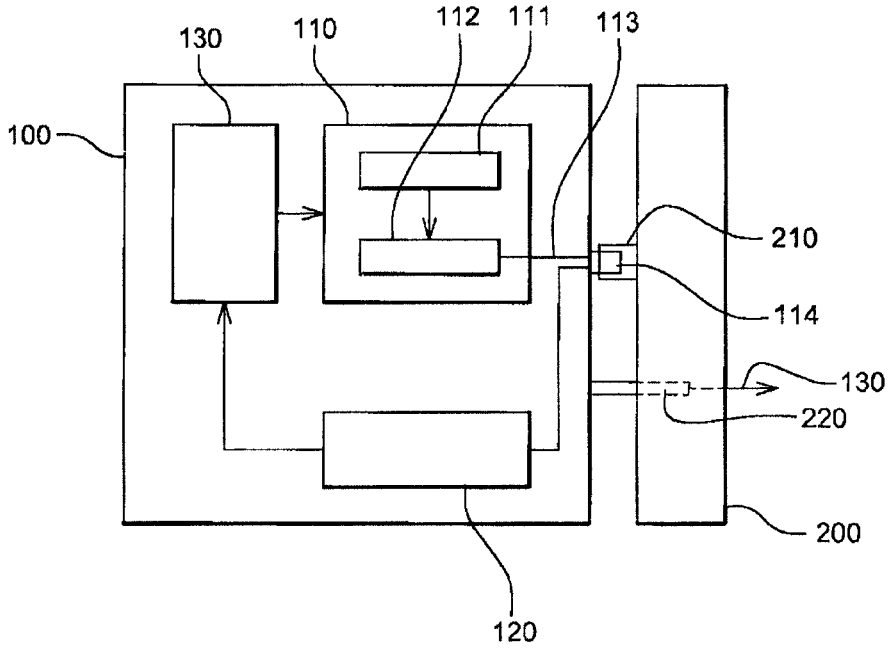
FIG. 1 is a functional diagram of a motor vehicle door.

FIG. 1 schematically shows a motor vehicle door 100.

The door 100 in FIG. 1 has an external opening control 110, also denoted EOC, which is intended to allow a user to open the door 100 from outside the vehicle. Conventionally, the EOC 110 has a handle 111 that can be operated by a tractional movement and can also be returned to its starting position by means of a return spring when the traction force ceases.

The handle 111 is connected mechanically to a control lever 112, the function of which is to pull on a cable 113 at the same time as the handle 111 is operated, in order to disengage the bolt 114 of the lock of the door 100 from the associated strike 210 which is located on a door pillar 200.

In FIG. 1, it is possible to see a safety device 130 of the external opening control 110, the aim of which is to ensure 100% that the door 100 remains closed in the event of a side impact with the door 100. In order to meet this requirement, the safety device 130 in FIG. 1 comprises active blocking means for the EOC 110, that is to say means that are capable of keeping the door 100 closed from the moment the user has entered his vehicle and not just in the event of a side impact, as for the known safety devices described above.

Figure 2:
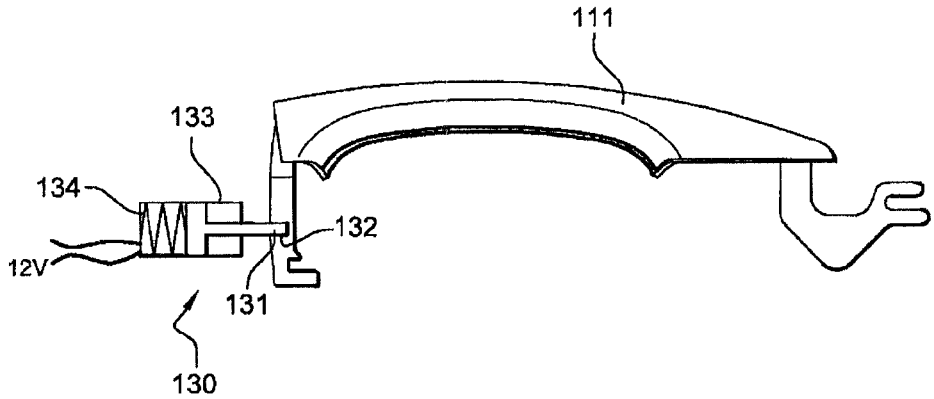
FIG. 2 is a diagram of a safety device of the opening control of the door from FIG. 1.

An exemplary embodiment of such blocking means 130 is given in FIG. 2.

In this example, the blocking means act directly on the handle 111 of the EOC 110. More precisely, a blocking member, represented here by a pin 131, can be moved into a position in which it is blocked in a slot 132 made in the mechanism of the handle 111. It is in this locked position of the handle 111 that the pin 131 is located as soon as the safety device is activated. By contrast, when the vehicle is at a standstill for example, it must be possible to disengage the pin 131 from its blocking position in order to allow the door 100 to be opened normally.

As is shown in FIG. 2, the activation of the blocking member 131 into its blocked position and also its deactivation can be carried out by means, for example, of a mechanical or electromechanical actuator 133 comprising an electromagnet, not shown, which is supplied by the vehicle battery, and a return means 134, such as an elastic means (spring or elastically deformable component). It will be noted that the electromechanical actuator can also be a geared motor.

In FIG. 1, it can be seen that the actuator 133 is activated by a sensor 220 for detecting the closure of the door when the door 100 is closed.

Of course, other means for activating the blocking means when the door 100 is closed can be envisioned, such as a starting operation of the vehicle or by an additional switch inside the passenger compartment.

Conversely, it must be possible to deactivate the blocking means when the door 100 is opened.

Thus, it is possible to envision that an internal opening control 120, or IOC, is coupled to a switch, not shown, located on the electrical power supply of the electromechanical actuator 133, so as to cut the power in the induction coil and to return the pin 131 to its unblocked position under the action of the return spring 134 of the actuator 133.

Alternatively, in a purely mechanical version of the blocking means, the blocking member, such as the pin 131, can be deactivated and moved into the unblocked position by mechanical coupling between the IOC 120 and the pin 131.

The blocking means can again be deactivated or activated with the aid of existing sensors or switches, in particular when the door is locked, when the key is inserted, etc.

It should be pointed out that the invention is not limited to the action of the blocking means on the handle 111, but also extends to the blocking of other elements of the EOC 110, such as the cable 113 control lever 112, it being possible for the pin 131 to serve both for blocking the movement of the lever 112 and for preventing in this way the opening of the door 100 once the user has entered his vehicle or while the vehicle is running, for example.

In order for emergency personnel to open the door 100 from outside the vehicle following an accident involving a side impact, it is advantageous for the blocking pin 131, for example, to be able to be broken without difficulty by an action exerted on the EOC 110. To this end, the pin 131 can be rendered breakable under a predefined force, that is to say is able to be broken with the aid of conventional means available to the emergency services for freeing people from inside vehicles that have been involved in an accident. However, it is also necessary that the pin 131 is capable of transmitting functional forces. Its mechanical strength must therefore be calibrated between a lower threshold equal to the inertial force applied to the handle in the event of a side impact and an upper threshold equal to the force exerted by the emergency equipment in order to open damaged doors.

Finally, it should be underlined that the safety device which has just been described can be installed in any vehicle door.

The invention claimed is:

1. A safety device for an opening control of a motor vehicle door, comprising:

a blocking member that engages with the opening control to block said opening control in the event of a side impact; and an actuator configured to activate said blocking member into the blocked position and to deactivate said blocking member from said blocked position, wherein said blocking member is breakable and is broken under an action exerted on the opening control following the side impact with said door.

2. The device as claimed in claim 1, wherein said blocking member blocks a handle of said opening control.

3. The device as claimed in claim 1, wherein said blocking member blocks a cable operating lever of said opening control.

4. The device as claimed in claim 1, wherein said blocking member comprises a pin configured to be introduced into a slot formed in the opening control.

5. The device as claimed in claim 1, wherein said actuator is a mechanical or electro-mechanical actuator.

6. The device as claimed in claim 1, wherein said blocking member is activated when said door is closed.

7. The device as claimed in claim 6, in which said actuator is activated by a sensor for detecting the closure of the vehicle door.

8. The device as claimed in claim 6, in which said blocking member is activated by a starting operation of the vehicle.

9. The device as claimed in claim 1, wherein said blocking member is deactivated when said door is opened.

10. The device as claimed in claim 9, in which said blocking member is deactivated by means of a switch coupled to a door internal opening control.

11. The device as claimed in claim 9, in which said blocking member is deactivated by mechanical coupling between a door internal opening control and said blocking means.

* * * * *